United States Patent [19]

Nilsson

[11] Patent Number: 4,762,313

[45] Date of Patent: Aug. 9, 1988

[54] PRODUCTION OF PAPER WITH DECORATIVE, NON-RECTILINEAR EDGES

[75] Inventor: Ingvar Nilsson, Akarp, Sweden

[73] Assignee: Svecia Antiqua SA, Fribourg, Switzerland

[21] Appl. No.: 21,650

[22] Filed: Feb. 26, 1987

Related U.S. Application Data

[62] Division of Ser. No. 821,956, Jan. 24, 1986, Pat. No. 4,669,644.

[30] Foreign Application Priority Data

Jan. 24, 1985 [GB] United Kingdom ..... 8501756

[51] Int. Cl.[4] ..... B65H 29/00

[52] U.S. Cl. ..... 271/187; 271/84; 271/315

[58] Field of Search ..... 271/187, 315, 84

[56] References Cited

U.S. PATENT DOCUMENTS 3,964,598 6/1976 Alsop ..... 271/315 X
4,511,136 4/1985 Yamada ..... 271/187
4,542,818 9/1985 Pavie ..... 271/315 X
4,668,148 5/1987 Sample ..... 271/84 X

*Primary Examiner*—Richard A. Schacher
*Attorney, Agent, or Firm*—Cushman, Darby & Cushman

[57] ABSTRACT

An apparatus for conveying sheets including a first conveyor and a second conveyor. The first conveyor conveys sheets in a first direction and the second conveyor conveys sheets in a second direction substantially perpendicular to the first direction. A mechanism is provided for transferring sheets conveyed by the first conveyor to the second conveyor. This mechanism includes a star wheel mounted at the longitudinal end of the first conveyor such that its longitudinal axis is disposed substantially transverse to the first direction and substantially parallel to the second conveying direction. In this manner, a sheet conveyed by the first conveyor is received intermediate the radial arms of the star wheel, brought into alignment with the second conveyor as the star wheel rotates and then can be transferred onto the second conveyor by a reciprocating structure.

4 Claims, 4 Drawing Sheets

PRODUCTION OF PAPER WITH DECORATIVE, NON-RECTILINEAR EDGES

This is a division of application Ser. No. 821,956, filed Jan. 24, 1986, now U.S. Pat. No. 4,669,644.

FIELD OF THE INVENTION

This invention relates to the trimming of paper webs, particularly in the production of paper in sheet or web form, more especially writing paper, with decorative, non-rectilinear edges, e.g. of a deckled nature.

BACKGROUND TO THE INVENTION

In the manufacture of hand-made paper in the form of sheets a decorative, irregular, outer edge is obtained. However, the manufacture of such paper is very expensive and such hand-made paper is made, therefore, only to a very limited extent.

It has been found that paper of the same high, and even more uniform quality than the existing hand-made paper can be produced by mechanical means, but that the same decorative edge structure is not obtained by this method owing to the mechanical paper being produced in an endless web and not in single sheets.

BRIEF DESCRIPTION OF THE INVENTION

The present invention provides a method of trimming a travelling web of paper along the longitudinal direction of the web comprising transporting the web through a trimming station and continuously trimming said web in said station, wherein said method comprises supporting a portion of said web on a support surface in said station such that a portion of said web to be trimmed off overhangs an edge of said support surface, contacting said overhanging portion of said web with a travelling endless member which crosses the edge of the said support surface to trap the overhanging portion of the web between the endless member and a tearing support member adjacent said edge to shear said overhanging portion continuously from the web.

Preferably, said web overhangs said support surface on both sides of the web and a said travelling endless member and tearing support member are provided on each longitudinal side of the support surface to trim both sides of the web.

Preferably, the web passes beneath at least one hold down member in said station and is held thereby against the support surface.

Preferably, the travelling endless member follows a run which includes a portion underlying a said hold down member and said web is pinched between the travelling endless member and the support surface.

The portions of the web trimmed off in said trimming station are continuously removed by suction through at least one collection duct.

Following said trimming along the longitudinal direction of the web, the web may be separated into sheets.

Preferably, said web is intermittently compressed along a line extending transversely of the web to produce a line of weakness and is torn along said line of weakness to produce said sheets.

Said tearing may be carried out by engaging the web between first and second pairs of opposed rollers at locations, spaced in the web travel direction, the downstream pair of rollers rotating in the web travel direction constantly or intermittently faster than the upstream pair.

Preferably, said downstream pair of rollers intermittently are rotating slower than said upstream pair and intermittently faster than said upstream pair so as to slacken and tighten the web to produce tearing along said lines of weakness.

The sheets may then be conveyed to a device which changes the orientation of the sheets with respect to their direction of travel by 90° so that those edges which were trimmed longitudinally prior to separation of the web into sheets become transverse to the direction of travel.

Such a device for changing the direction of sheet orientation with respect to the direction of travel may operate by changing the direction of sheet travel by 90° while leaving the orientation of the sheets with respect to the web travel direction unaltered.

The change in travel direction may be accomplished by depositing each sheet between radial arms of a star wheel comprising a hub and a plurality of radial arms extending therefrom, the arms being suitably provided by coplanar sets of rods, each sheet being deposited in a radial direction with respect to said hub, and removing each sheet from said star wheel in a direction parallel to the axis of said hub.

The sheets may be conveyed in their new travel orientation to a second trimming station for the trimming of one or both edges.

In said second trimming station a main portion of each travelling sheet may be supported on a support surface in said station such that a portion to be trimmed off overhangs an edge of said support surface, and said overhanging portion may be contacted with a travelling endless member which crosses the edge of said support surface to trap the overhanging portion of the sheet between the endless member and a tearing support member adjacent said edge to shear said overhanging portion continuously from the sheet.

Normally, each sheet overhangs said support surface on both sides of the sheet and a said travelling endless member and tearing support member are provided on each longitudinal side of the support surface to trim both sides of the sheet.

The sheets may be transported through said second trimming station between a pair of endless belts, one of which constitutes the said support surface of said station.

Preferably, the or each said endless travelling member is a belt and preferably, the or each tearing support member is a roller.

The position of the or each tearing support member is preferably adjustable.

Suitably, the position of the or each tearing support member is adjustable laterally of the respective support surface and/or in a direction perpendicular to said support surface.

Edge zones of the trimmed web and/or edge zones of the trimmed sheets may be further trimmed in the longitudinal direction of the respective edge to remove any excessively protruding areas.

Areas of said web may be provided with water marks or areas of differential thickness, translucency and/or texture visually resembling water marks (psuedo-water marks).

Preferably, said webs are provided with psuedo-water marks by abrading a surface of the web with an abrading member whilst supporting the web against a 3-dimensionally patterned support member.

The appearance of the final product may be enhanced if the water marks or psuedo-water marks form lines along each edge of the web along which the web is trimmed and/or lines across the web along which the web is separated into sheets.

The invention includes apparatus for trimming a travelling web of paper along the longitudinal direction of the web comprising a trimming station, means for transporting a web to be trimmed through the trimming station, a support surface in said station for supporting a portion of said web such that a portion of said web to be trimmed off may overhang an edge of said support surface, a travelling endless member which crosses the edge of the said support surface, and a tearing support member adjacent said edge and opposing a portion of the run of the endless travelling member whereby in use said travelling endless member contacts said overhanging portion of said web, to trap the overhanging portion of the web between the endless member and the tearing support member adjacent said edge to shear said overhanging portion continuously from the web.

Suitably, the apparatus is adapted to operate according to the preferred methods described above.

DESCRIPTION OF THE DRAWINGS

The invention will be illustrated by the following description of a preferred embodiment with reference to the accompanying drawings in which:

FIG. 5 is an enlarged side elevation of the pseudo-water mark grinding station of FIG. 1*a.

DETAILED DESCRIPTION OF PREFERRED EMBODIMENT

Figure 1A:
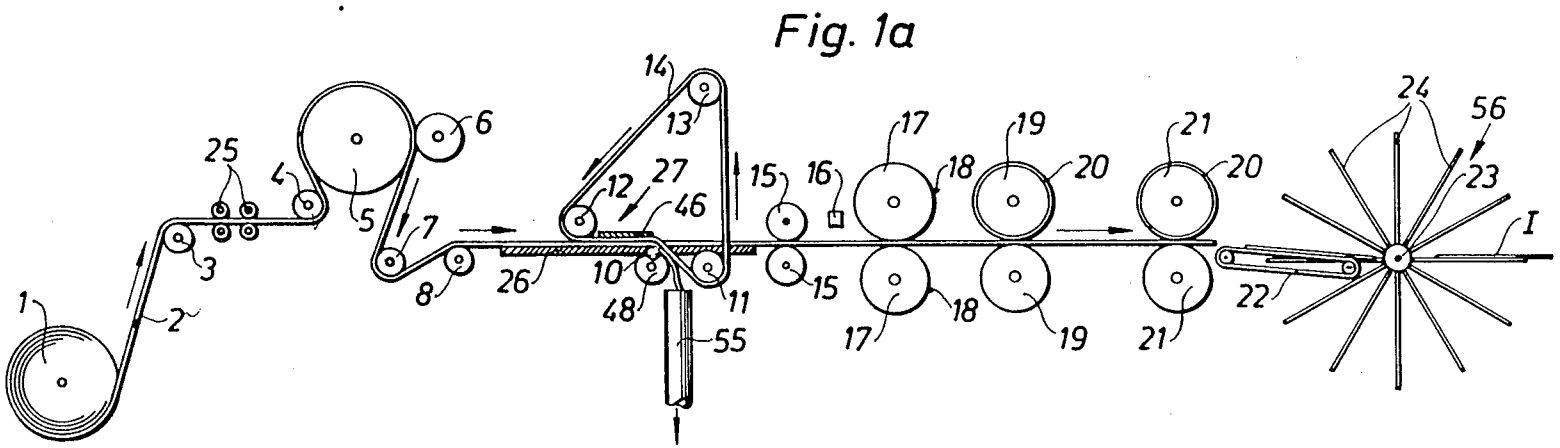
FIG. 1*a* is a schematic side elevation of an upstream part of apparatus according to the invention.

In the first place, a general description of the function of the machine will be given. A paper web 2 which is slightly wider than the desired width of the finished sheet is reeled off a magazine roll 1 and is passed over a deflection roller 3. Since the paper web 2, which is stored on the roll acquires a tendency to curl up, the paper web 2 is drawn through a so-called decurling device 25 consisting of two pairs of rollers placed at a distance from each other and of bars or guide surfaces arranged between them which are vertically adjustable and over which the web is led. Owing to the web 2 being drawn over the said bars or guide surfaces, which are set in such a manner that the web obtains a tendency to curve in a direction opposite to its curling, the web will be substantially plane when it has passed through the decurling unit. The web 2 is passed subsequently over a deflection roller 4 and up onto a matrix cylinder 5 whose function and appearance will be described in greater detail in the following under the heading of "Grinding". The web 2 is passed over the matrix cylinder 5 and down over a further deflection roller 7. Adjoining the matrix cylinder 5, a rapidly rotating grinding cylinder 6 is arranged with the help of which selected parts of the web 2 are ground off, so that weakening lines, folding lines, perforations or figured marks of the type of water marks are formed, which is made possible by the grinding being carried out at varying depth on portions adjoining each other.

The grinding is not a precondition for the function of the machine and the grinding unit may be disengaged, e.g. by removing and disconnecting the grinding cylinder 6.

Figure 2:
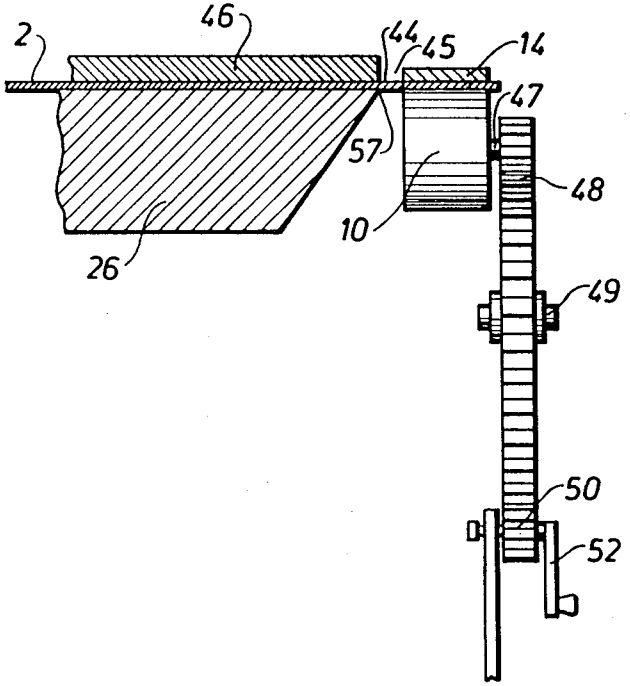
FIG. 2 is an elevation of the tearing mechanism of the apparatus of FIG. 1*a* looking along the web transport direction with the web and the other elongate parts shown in section.

The web 2 subsequently is passed over the deflection roller 8 whereupon it is advanced to the edge tearing unit which substantially consists of an endless belt 14 which runs over the deflection rollers 11, 12 and 13 and over a tearing pulley 10 which is adjustable in its position. The function of the edge tearing will be described in greater detail in the following, but by and large the tearing is carried out so that the web 2 is conveyed over a supporting member 26, the edge zones of the web 2 intended for tearing off being covered by the tearing belts 14 along the area 27 between the deflection roller 12 and the tearing pulley 10. The central zone of the web is held down by a hold-down member 46. Outwardly of the central zone, rollers 12 act as hold down members and the belts 14 pass beneath them. The edges of the support surface are sharpened at 57 (FIG. 2). The said edge zones which are held fast between the belts 14 and the tearing pulleys 10 will be pulled along with the belts as these move down towards the deflection rollers 11, the edge zones being torn off as strips which are collected in, and sucked away through, a tubing 55. The edge zones of the web 2, as a result of the tearing, have obtained an uneven, decorative edge which, however, does not have a defined, matched, transverse dimension, since certain edge portions may jut out in front of the others. Since it is important that there should be an exact transverse dimension on the finished sheets, the uneven edge is trimmed with the help of cutting rollers 15 which cut away the tops of the uneven edge so that an exact transverse dimension on the web 2 is achieved. As the longitudinal edges of the web are now finish-torn and trimmed, the web will be divided up into sheets, the transverse zones of which also have to be torn so as to obtain a decorative edge structure, and subsequently be trimmed, so that the sheet obtains a specified longitudinal dimension.

In the case where the sheet has been provided with water marks, which may be so-called true water marks, produced already in conjunction with the paper manufacture or marks provided in the web 2 by means of grinding, these water marks or other marks must be located in such a manner on the paper sheets that they reappear again at a certain specified place on each sheet. In order to achieve this it is necessary that the division of the web 2 into sheets should take place bearing in mind the placing of the said marks, that is to say the division into sheets has to take place in register with the placing of the marks. For this purpose, a reading device is arranged, preferably a photocell device 16, which, e.g. by transillumination of, or reflective radiation against, the web, detects and reads the said mark in its position, and as a function of the reading result delivers a pulse to a controller by means of which a pair of cylinders 17 provided with compression tools 18 is made to engage with the web in order to carry out a linear pressing down of the paper material across the web 2 so as to crush the paper fibres and weaken the web along the said compression zone across the longitudinal direction of the web. This compression arrangement 17 may be substituted in principal by a perforation device and in both cases it is the intention to weaken the strength of the paper web 2 along the processing zone. By controlling the working cycle of the processing cylinders 17 by the photocell device 16, the paper web, which normally passes freely between the cylinders 17, can be compressed in the manner indicated above in a linear zone across the web 2, the said linear compression zone always having a matched position in relation to the marks read by the photocell device 16.

The web 2, thus provided with transverse weakening lines, is introduced between two cylinders 19, the upper of which cylinders is rubber-covered whereas the other one is a steel cylinder. The cylinders 19 rest against each other under a certain adjustable spring force so that the paper web 2 can be introduced and pass between the cylinders 19 as they rotate whilst being held fast at the same time between the cylinders so that any actual sliding between the paper web 2 and the cylinders 19 cannot occur. The cylinders 19 are driven at a constant speed which corresponds to the speed of the web 2 in all the foregoing operations. After it has passed the pair of cylinders 19, the paper web 2 is introduced between a second pair of cylinders 21 which in principle is the same as the pair of cylinders 19, that is to say the driven cylinder has a rubber covering 20 whereas the other cylinder is a steel cylinder. However, the cylinders in the pair of cylinders 21 are not at a constant driving speed and their mean speed is a little higher than the speed of the pair of cylinders 19 with the help of a planetary gear train which is driven by a cam, coupled to the driving device for the compression cylinders 17. With the help of the planetary gear train which is controlled by the said cam the driving speed of the cylinders 21 can be increased or diminished owing to the planetary gear train providing a periodical additional contribution to, or a reduction of, the driving speed of the cylinders 21. In principle the arrangement functions in such a manner that the web 2 advanced between the cylinders 19 is fed in between the pair of cylinders 21. The pair of cylinders 21, however, moves in this part of the working cycle at a lower speed than the pair of cylinders 19, which means that the pair of cylinders 19 advances more of the web 2 than is taken up between the pair of cylinders 21. This means, though, that there will be a so-called "slack" on the web. In the next part of the working cycle, however, the driving speed of the cylinders 21 is increased so that the cylinders 21 advance the web 2 at a considerably higher speed than it is advanced between the cylinders 19. This means that the said "slack" on the web 2 is not only compensated, but that the web 2 is pulled away so that rupture takes place in the previously mentioned weakened zones across the web 2, which were produced with the help of the compression tool 18 which is located on the cylinders 17. The front part of the web 2 pulled away is advanced at a higher speed that the remainder of the web which is controlled by the pair of cylinders 19 and the separated part of the web is delivered onto a conveyor 22 consisting of a number of parallel endless belts, this conveyor being driven synchronously with a take-up star wheel 56.

When the separated sheets have been delivered onto the conveyor 22 they will be collected by rodlike arms 24 which are adapted to move in between the belts of the conveyor 22. The said rodlike arms 24 are arranged in several sections parallel with one another on a joint stepwise indexed centre 23, the rate of indexing of which is adapted to the rate of feed of the sheets. The separated sheets which are delivered onto the conveyor 22 are thus captured and lifted off the conveyor by the said rodlike arms 24.

Figure 1B:
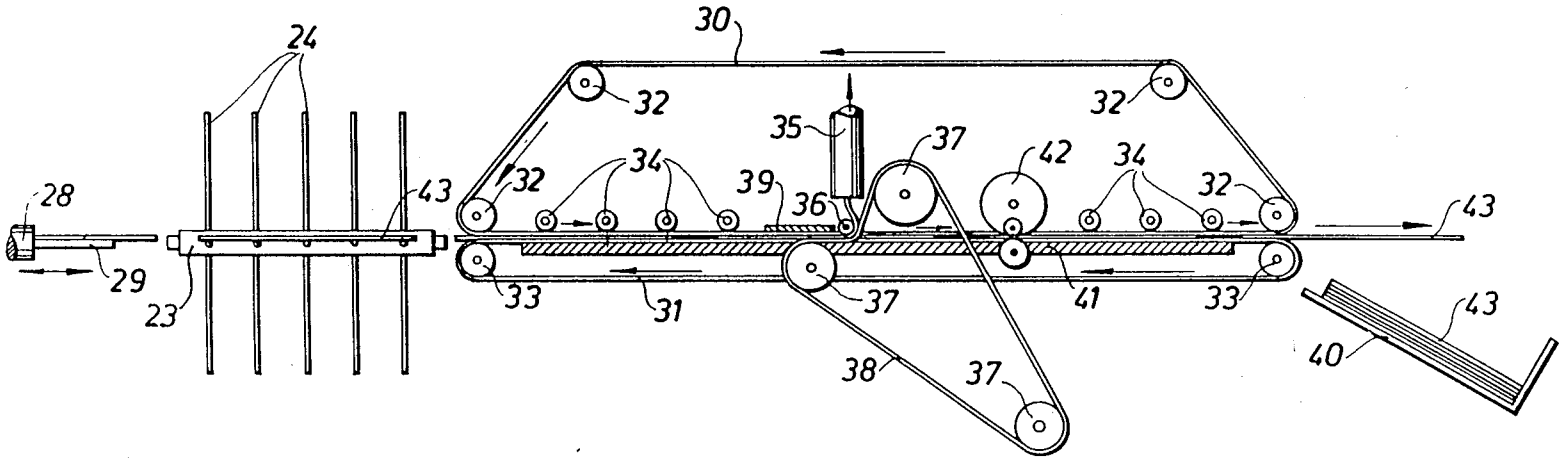
FIG. 1*b* is a side elevation of the downstream part of the apparatus of FIG. 1*a;*

In FIG. 1*b* is shown a continuation of the machine which is set at an angle of 90° to the machine shown in FIG. 1*a*. In the part of the machine shown in FIG. 1*b*, the tearing of the short sides of the separated sheets is performed so that a decorative edge zone is formed whereupon the said edge zone is trimmed to the exact longitudinal dimension of the individual sheets.

As mentioned earlier, the separated sheets are transported with the help of the stepwise rotating star wheel arrangement 56 in such a manner that the sheets are turned by 180°. When the sheets have been brought into position I in FIG. 1*a* which is shown in the left part of FIG. 1*b*, the sheets are displaced to the right off the star wheel 56 by means of a reciprocating finger 29 which is controlled by a pneumatic or hydraulic cylinder 28 so that the sheets 43 can be inserted between two endless travelling bands 30 and 31, these bands capturing and transporting the sheets 43 between them.

The upper band 30 runs between deflection rollers 32 and the lower band 31 runs between deflection rollers 33 and slides over a fixed base 41. The bands 30 and 31 can be pressed towards each other with the help of rollers 34 which act against the inside of the band 30 in the region where the two bands lie adjoining each other. The width of the bands 30 and 31 is less than the length of the sheet 43 so that the edge zones of the sheets 43 project beyond the bands 30 and 31. On introduction between the bands 30 and 31 the sheets 43 are adjusted carefully in lateral direction so that the position of the projecting edge zones is accurately controlled. The individual sheets 43 are transported between the bands 31 and 30 with the said edge zones of the sheets being guided in over a belt 38 of an edge tearing device provided on each side of the apparatus. The edge zones of the sheets 43 will be pressed against the belts 38, one belt whereof is arranged on either side of the machine. Tearing pulleys 36 overlie each belt 38 and the edge portions of the sheets. When the edge zones of the sheets 43 approach the tearing pulleys 36 the edge zones will be taken up between the tearing pulleys 36 and the tearing belts 38 and when the tearing belts 38 are led upwards the edge zone will be torn off, whereupon the waste strip is removed by being sucked up through a tube 35. The tearing belts 38 are endless belts which are passed over deflection rollers 37. After the edge tearing operation the sheets 43, now having torn edges, are conveyed past cutting discs 42 set at an accurate distance from each other, by means of which the tops of the torn edges which project beyond the nominal longitudinal dimension of the sheets 43 are cut off. The sheets 43 are conveyed further between the belts 30 and 31 and are deposited in a collecting device 40.

In the following, a special description will be given of the tearing and grinding arrangements mentioned earlier in the text.

Figure 3:
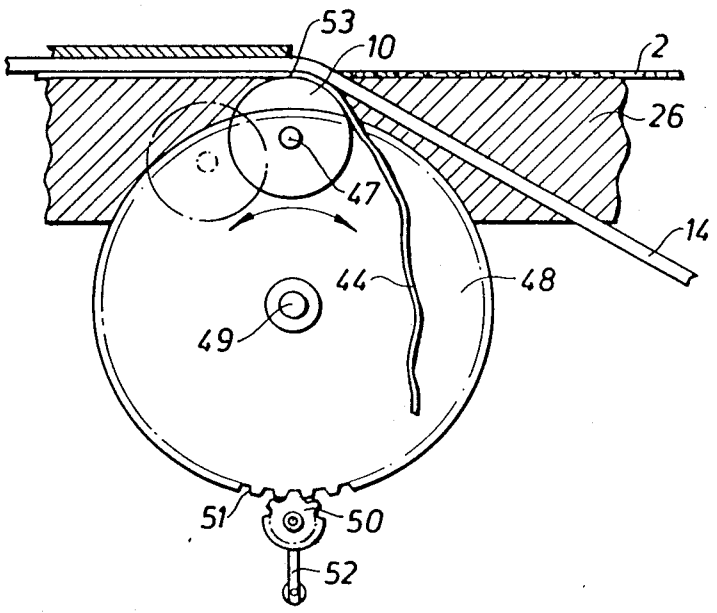
FIG. 3 is a side elevation corresponding to FIG. 2.

DESCRIPTION OF THE TEARING ARRANGEMENT (FIGS. 2 and 3)

The position of the tearing pulley 10 in relation to the position of the sharp tearing edge 57 on the supporting member 26 can be regulated and this is done with the help of an arrangement as shown in FIGS. 2 and 3. The arrangement is constituted of a plate 48 which is supported so that it can rotate on an axle 49, this axle being parallel with the supporting surface of the supporting member 26. The plate 48 carries in its upper part the tearing pulley 10 which is supported so that it can rotate on an axle 47, this axle being fixed in the plate 48. When the plate 48 is rotated so that the tearing pulley 10 attains its highest point relative to the supporting surface of the supporting member 26 the top surface 53 of the tearing pulley 10 lies level with the supporting surface of the supporting member 26. By turning the plate 48 the surface 53 can be lowered in relation to the supporting surface of the supporting member 26. This rotation of the plate 48 may be done e.g. in that the plate 48 is provided with a rim gear 51 (FIG. 3). This rim gear can be made to engage with a gear 50 which can be manoeuvred by a crank 52. Naturally the rotation of the plate may be done in any other known manner, but that given here has proved to be a simple and functional solution.

Figure 4:
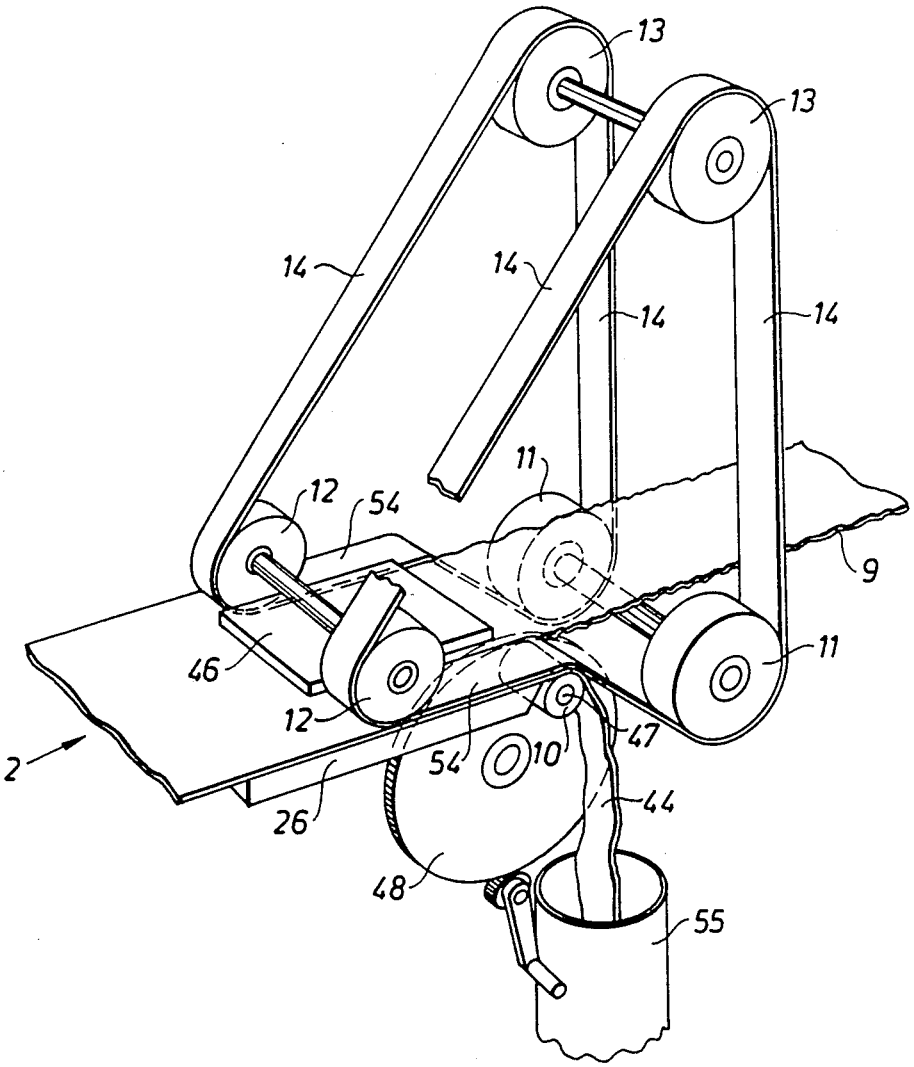
FIG. 4 is a perspective view of the tearing arrangement of FIG. 2.

The arrangement with the tearing pulley 10 can also be positionally adjusted in horizontal direction, that is to say a direction perpendicular to the plane of the paper in the figure shown. This can suitably be done in that the attachment of the axle 49 is arranged on a support which is displaceable in horizontal direction, so that it is made possible for the gap 45 between the tearing pulley 10 and the tearing edge 57 of the supporting member 26 to be adjusted to an appropriate distance, taking into account the tearing result intended and the paper quality used. When the tearing is to be carried out this is done with the help of the endless belt 14 which runs over supporting rollers 8 and over the tearing pulley 10, this belt 14 being driven by a driving device the speed of which can be regulated. One part of the belt 14 is always in engagement with the edge zone of the web 2 and this part of the belt is designated 54 in FIG. 4. When the edge zone of the paper web 2, which is covered by the belt 14, runs over the tearing pulley 10 the edge zone of the web 2 will be held fast between the tearing pulley 10 and the underside of the belt 14. When the belt 14 runs over the tearing pulley 10 and is guided downwards, the edge zone of the paper web 2 will follow, therefore, along with the belt 14 and will thus be torn off the paper web 2 and be removed as a waste strip 44 which is sucked away through a suction line 55. In the tearing process the edge 9 of the paper web 2 has obtained an uneven but decorative edge structure of the type aimed at and the appearance of this edge structure can be varied in several ways.

In the first place it is obvious that the size of the gap 45 between the tearing pulley 10 and the tearing edge 57 of the supporting member 26 influences the roughness of the edge structure. If the distance 45 is adjusted to a minimum it is thus possible to obtain a near enough razor-sharp and straight cutting line which does not present any major unevennesses whereas, by contrast, an increased gap 45 gives a more uneven tearing edge.

The tearing result can also be influenced to a large extent in that the tearing pulley in the manner described earlier is displaced vertically in relation to the tearing edge 57 of the supporting member 26. This is done in that the plate 48 is rotated, so that the tearing pulley 10 by being swivelled about the axle 49 of the plate 48 will be positioned with its top surface 53 below the tearing edge 57. This means that on passing over the tearing edge 57 the paper web 2 will be curved downwards in order to lie against against the surface of the tearing pulley 10, and it has been found that this brings about a better controlled tearing and that in certain cases a more decorative tearing edge can be achieved in this manner.

Another factor which affects the tearing result is the speed of the tearing belt 14. At a first glance at the problem it seems natural that the tearing belt 14 should be at the same speed as the advancing paper web 2. It has been found, however, that this is not the case and a better controlled tearing is achieved if the tearing belt 14 is at a slightly higher speed (between 1–5%) than the paper web 2. This is due probably to the tearing being facilitated by the initiation of tensile stresses in longitudinal direction of the paper edge as well as in transverse direction.

The tearing arrangement for the tearing of the longitudinal edges of the web and the tearing arrangement for the tearing of the short sides of the separated sheets are in principle the same. In the description of the machine given here it is generally so that the longitudinal edges are torn downwards whereas the short sides of the sheets are torn upwards. As mentioned previously, though, the tearing procedures in principle do not differ from one another.

Figure 6:
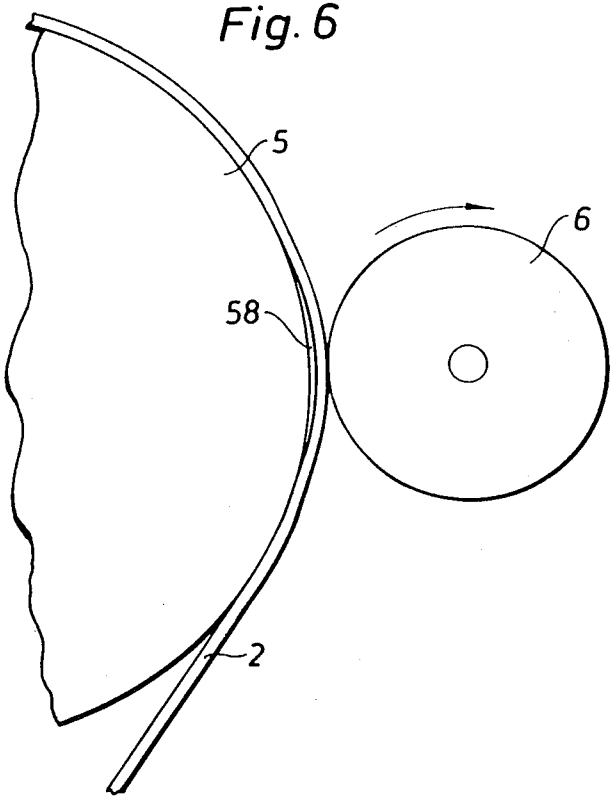
* and FIG. 6 is a still further enlarged portion of FIG. 5.
Figure 5:
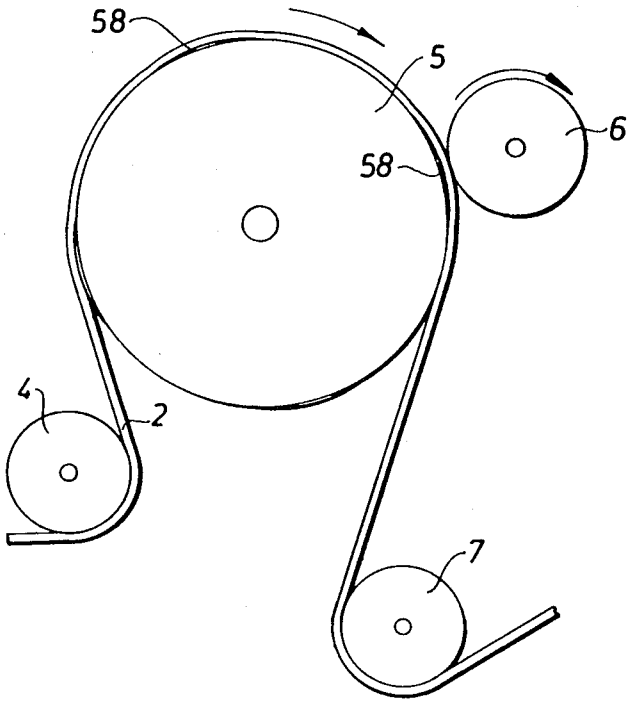

GRINDING (FIGS. 5 and 6)

In the manner as shown in FIG. 5 and 6 is carried out the grinding of e.g. marks of the type of water marks, but it is also possible with the help of grinding to produce coherent folding lines, e.g. lines extending longitudinally or transversely to the direction of the web, and it is possible, for example, by means of grinding to substitute the weakening of the web which is carried out with the help of the cylinders 17 where a local region across the web is compressed in such a manner that the fibres in the paper are crushed.

In FIG. 5 is shown how the web 2 is passed over deflection rollers 4 and 7 and over the matrix cylinder 5. The matrix cylinder 5 is provided with local prominences 58 which are in contact with the regions of the web 2 on which the grinding is to be performed. Close by the matrix cylinder 5 is arranged a grinding cylinder 6 which rotates at a high speed preferably in a direction which results in a grinding direction opposite to the direction of feed of the web 2. The distance between the grinding cylinder 6 and the matrix cylinder 5, which is adjustable, is sufficient that the paper web 2 can usually pass without hindrance between the grinding cylinder 6 and the matrix cylinder 5, which means that the surface of the grinding cylinder does not make contact with the web 2, so that within those areas where the clearance is equal to, or greater than the web thickness no processing of the web is taking place. However, the matrix cylinder is provided with local prominences 58 which are of a size of one or more tenths of a millimeter but may also amount to substantial fractions of the thickness of the web (if a complete grinding through, such as e.g. a perforation, is required the prominences 58 must be of a thickness equal to the web 2). When a part of the matrix cylinder 5 which carries a prominence 58 moves past the grinding cylinder 6 the paper web will be raised up towards the grinding cylinder 6 and a part of the paper web which corresponds to the raised part will be ground away. In this manner a "grinding image" is obtained in the web 2 which substantially corresponds to the shape, height and position of the prominences 58. In FIG. 5 is shown on an enlarged scale how the grinding is carried out and how the web 2 is raised and pressed against the grinding cylinder 6 so that the distance between the grinding cylinder 6 and the elevated part 58 of the matrix cylinder 5 will be smaller than the thickness of the web 2, which means that in order to be able to pass the grinding cylinder 6 the web has to be ground off within the elevated area 58 and the matrix cylinder 5.

Whilst the invention has been described with reference to particular preferred characteristics of the illustrated embodiment, it will be appreciated that many modifications and variations thereof are possible within the scope of the invention.

I claim:

1. A conveyor apparatus comprising:

a first conveyor means for conveying sheets in a first direction;

a second conveyor means for conveying sheets in a second direction, substantially perpendicular to first direction; and means for receiving sheets conveyed by said first conveying means and for supplying said sheets conveyed by said first conveying means to said second conveying means, said means for receiving and supplying including:

a star wheel having an axially elongated hub, having a plurality of arms extending radially from said hub and spaced circumferentially about said hub, said star wheel being mounted at a longitudinal end of said first conveyor means, a longitudinal axis of said hub being disposed substantially transverse to said first direction so as to receive sheets from said first conveying means between circumferentially successive arms of said star wheel, said star wheel further being disposed at a first longitudinal end of said second conveying means such that said longitudinal axis of said hub is substantially parallel to said second direction;

means for rotating said star wheel about said longitudinal axis of said hub; and reciprocal means for displacing sheets from said star wheel onto said second conveying means in a direction substantially parallel to said longitudinal axis of said hub.

2. An apparatus as claimed in claim 1, wherein said star wheel has a plurality of circumferentially spaced groups of radially extending arms, the arms in each said group being spaced axially along said hub and substantially mutually parallel to one another, said first conveying means including a plurality of parallel conveyor units interdigitating with the arms of each said group as said star wheel rotates about said axis.

3. An apparatus as claimed in claim 1, wherein said first and second conveying means convey sheets substantially horizontally.

4. An apparatus as claimed in claim 3, wherein said first and second conveying means convey sheets in substantially coincident horizontal planes.

* * * * *